US009631595B2

(12) United States Patent
Li et al.

(10) Patent No.: US 9,631,595 B2
(45) Date of Patent: Apr. 25, 2017

(54) METHODS AND SYSTEMS FOR SELECTIVE ENGINE STARTING

(71) Applicant: Ford Global Technologies, LLC, Dearborn, MI (US)

(72) Inventors: Yonghua Li, Ann Arbor, MI (US); Siamak Hashemi, Farmington Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 199 days.

(21) Appl. No.: 14/038,531

(22) Filed: Sep. 26, 2013

(65) Prior Publication Data

US 2015/0083079 A1 Mar. 26, 2015

(51) Int. Cl.

*F02D 31/00* (2006.01)
*F02N 11/08* (2006.01)
*F02N 99/00* (2010.01)

(52) U.S. Cl.

CPC ..... *F02N 11/08* (2013.01); *F02N 99/006* (2013.01); *F02N 2200/022* (2013.01); *F02N 2200/023* (2013.01); *F02N 2200/04* (2013.01); *F02N 2200/041* (2013.01); *F02N 2200/046* (2013.01); *F02N 2200/06* (2013.01); *F02N 2200/063* (2013.01); *F02N 2200/064* (2013.01); *F02N 2200/122* (2013.01); *F02N 2300/102* (2013.01); *F02N 2300/104* (2013.01); *F02N 2300/2002* (2013.01)

(58) Field of Classification Search

CPC ..... F02N 2300/102; F02N 2200/00; F02N 2200/022; F02N 2200/023; F02N 2200/04; F02N 2200/041; F02N 2200/046; F02N 2200/06; F02N 2200/061; F02N 2200/062; F02N 2200/063; F02N 2200/064; F02N 2300/00; F02N 2300/10; F02N 2300/104; F02N 2300/2002

USPC ..... 123/179.28, 179, 3, 179.4; 73/114.23, 73/114.59

See application file for complete search history.

(56) References Cited

U.S. PATENT DOCUMENTS 5,631,540 A * 5/1997 Nguyen ..... G01R 31/3624 320/127
6,007,451 A 12/1999 Matsui et al.
(Continued)

FOREIGN PATENT DOCUMENTS

IN 2011MUM02780 A 10/2012
WO 2004009395 A2 1/2004

OTHER PUBLICATIONS

Plett, Gregory L., "High-Performance Battery-Pack Power Estimation Using a Dynamic Cell Model," IEEE Transactions on Vehicular Technology, vol. 53, No. 5, Sep. 2004, 8 pages.
(Continued)

*Primary Examiner* — Hung Q Nguyen
*Assistant Examiner* — Kevin R Steckbauer
(74) *Attorney, Agent, or Firm* — David Kelley; McCoy Russell LLP

(57) ABSTRACT

Systems and methods for starting an engine are described. In one example, engine cranking speed for an engine of a hybrid vehicle is adjusted in response to operating conditions. The engine cranking speed may be reduced when capability of a battery that supplies power to rotate the engine is less than an amount of power to rotate the engine at a higher speed.

10 Claims, 5 Drawing Sheets

(56) References Cited

U.S. PATENT DOCUMENTS 6,364,807 B1 4/2002 Koneda et al.
6,612,386 B2 * 9/2003 Tamai ..... B60K 6/48 180/65.25
7,237,521 B2 * 7/2007 Yuya ..... F02N 11/08 123/179.1
7,321,220 B2 1/2008 Plett
7,322,331 B2 * 1/2008 Tamagawa ..... F02N 11/08 123/179.3
7,755,331 B2 * 7/2010 Kawahara ..... B60L 11/1803 320/159
7,764,049 B2 7/2010 Iwane et al.
7,913,548 B2 * 3/2011 Ono ..... F02D 41/0097 73/114.25
8,020,652 B2 * 9/2011 Bryan ..... B60K 6/445 180/65.285
8,103,485 B2 1/2012 Plett
8,157,705 B2 4/2012 Yu et al.
8,244,449 B2 * 8/2012 Mizuno ..... G01R 31/361 123/179.4
8,380,388 B2 * 2/2013 Shin ..... F02N 11/108 701/29.1
8,655,526 B2 * 2/2014 Schwenke ..... F02N 11/0862 701/113
8,753,246 B2 * 6/2014 Huber ..... B60K 6/365 123/179.3
8,763,582 B2 * 7/2014 Lewis ..... F01L 9/04 123/179.16
8,818,611 B2 * 8/2014 Shin ..... F02N 11/08 123/339.14
8,983,697 B2 * 3/2015 Toki ..... B60K 6/48 701/22
2002/0179348 A1 * 12/2002 Tamai ..... F02D 41/062 180/65.25
2006/0087291 A1 * 4/2006 Yamauchi ..... B60L 11/1811 320/137
2007/0102208 A1 * 5/2007 Okuda ..... B60K 6/48 180/65.31
2011/0295459 A1 * 12/2011 Shin ..... F02N 11/108 701/33.7
2012/0179312 A1 * 7/2012 Schwenke ..... F02N 11/0862 701/22
2015/0122203 A1 * 5/2015 Ideshio ..... B60K 6/48 123/2

OTHER PUBLICATIONS

Xiong, Rui et al., "Online Estimation of Peak Power Capability of Li-Ion Batteries in Electric Vehicles by a Hardwire-in-Loop Approach," Energies 2012, vol. 5, ISSN 1996-1073, 15 pages.
Plett, Gregory L., "Results of Temperature-Dependent LiPB Cell Modeling for HEV SOC Estimation," Jun. 27, 2005, 8 pages.
Anonymous, "The Concept, Method, Mechanism, and an Augmentation to Allow the Efficient "On Track" Use of a Low Voltage Testing Device," IPCOM No. 000228120, Published Jun. 6, 2013, 4 pages.

* cited by examiner

METHODS AND SYSTEMS FOR SELECTIVE ENGINE STARTING

FIELD

The present description relates to a system and method for starting an engine of a hybrid vehicle. The methods may be particularly useful for vehicles that may experience a variety of operating conditions.

BACKGROUND AND SUMMARY

A hybrid vehicle may include an engine and a motor that may be in mechanical communication. The motor may augment engine torque during conditions of high driver demand. The motor may also be used as sole propulsion force under certain conditions. The motor may also convert the vehicle's kinetic energy into electrical energy for use at a later time. Further, the motor may be used to start the engine when the engine is stopped. The engine may be started via the motor when the engine is warm or cold, and friction within the engine may change significantly between lower engine temperatures and higher engine temperatures. Consequently, the motor may need to supply additional torque to rotate the engine at lower temperatures. However, a battery supplying power to the motor may provide less charge at lower temperatures and it may discharge to some extent if the battery is not charged over a period of time. Therefore, it may be difficult to crank the engine at a repeatable speed during engine starting, and as a result, engine emissions may degrade.

The inventors herein have recognized the above-mentioned disadvantages and have developed a method for starting an engine, comprising: adjusting an engine cranking speed in response to battery power capability and an amount of power to crank an engine at a desired engine speed; and cranking the engine at the adjusted cranking speed.

By adjusting engine cranking speed in response to battery power capability and an amount of power to crank the engine at a desired engine speed, it may be possible to provide the technical result of lowering engine emissions and reducing engine controller calibration complexity. Further, the potential for a non-starting engine may also be reduced. For example, if a battery has less power capability to rotate an engine at a desired speed than the amount of power needed to rotate the engine at the desired speed, the engine cranking speed may be reduced to a lower speed where a fine-tuned engine starting calibration may be provided. Further, a predetermined number of engine cranking speeds may be established so that only a finite number of engine starting calibrations are used during engine starting. In this way, the engine may be started according to more limited starting conditions where an engine starting calibration may be more optimized.

The present description may provide several advantages. In particular, the approach may reduce engine starting emissions. Further, the approach may reduce the complexity of calibrating a controller for engine starting. Further still, the approach may improve engine starting over a wide range of engine operating conditions.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The advantages described herein will be more fully understood by reading an example of an embodiment, referred to herein as the Detailed Description, when taken alone or with reference to the drawings, where.

DETAILED DESCRIPTION

Figure 2:
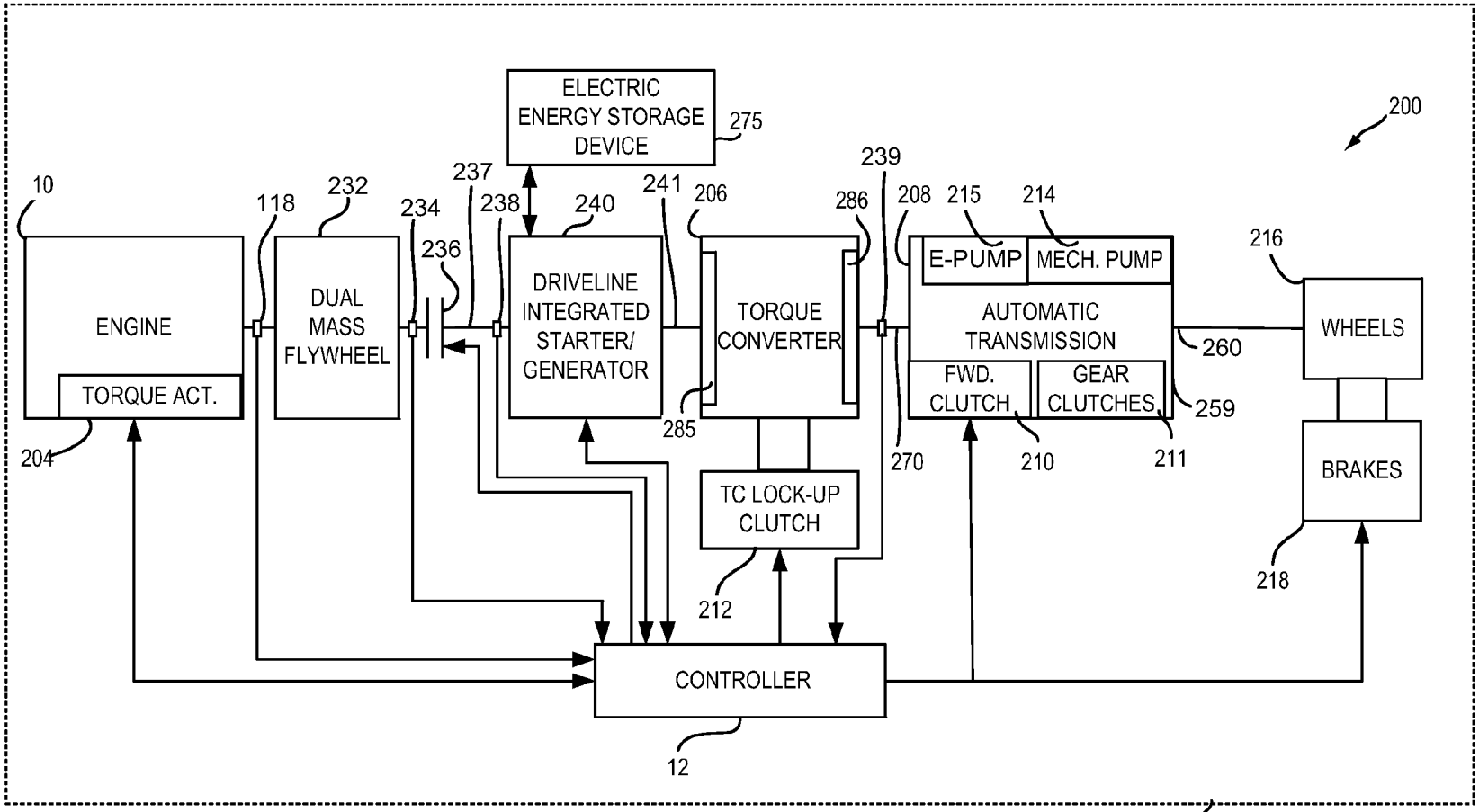
FIG. 2 shows an example vehicle driveline configuration.
Figure 3:
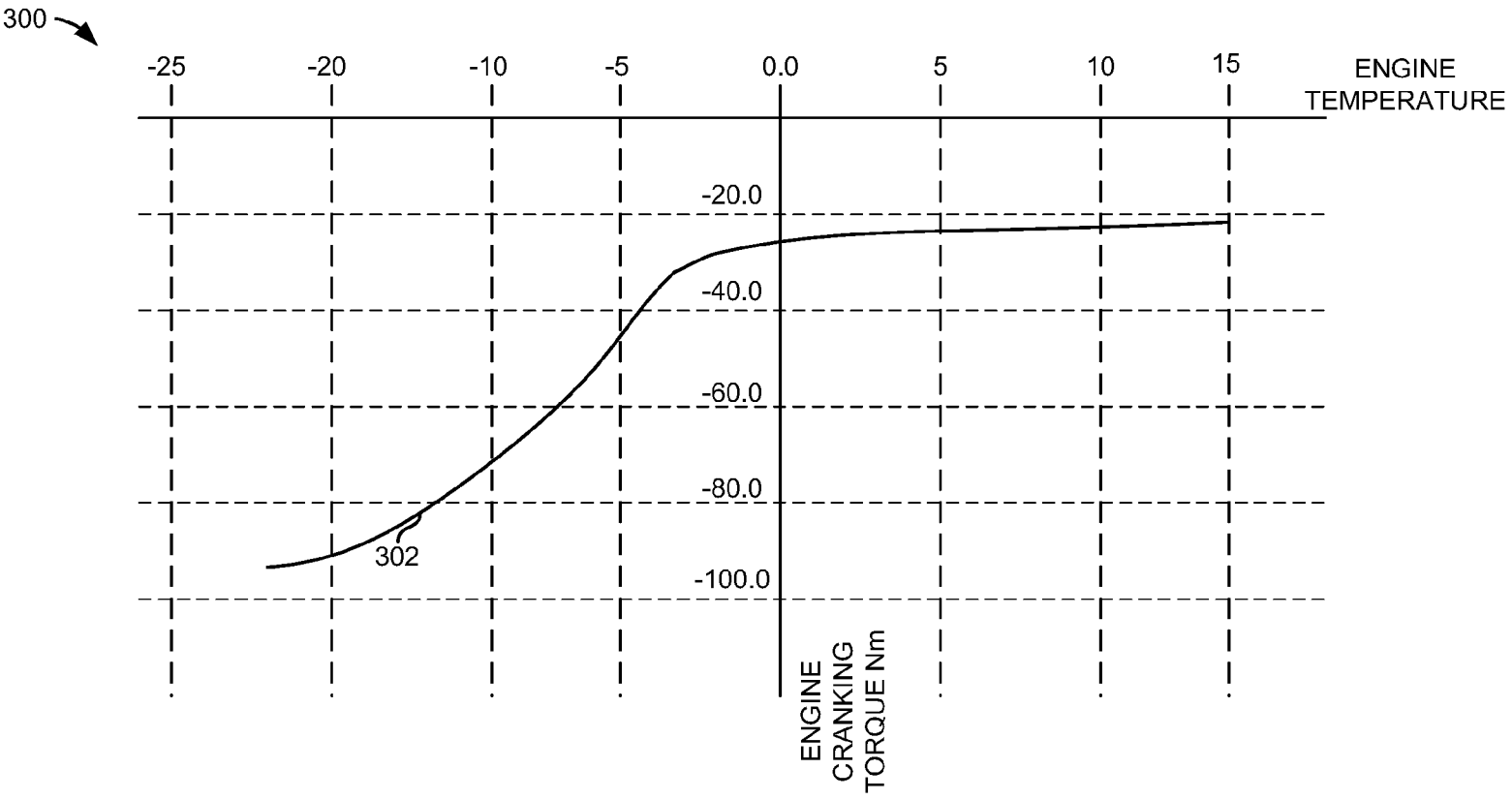
FIG. 3 shows a plot of engine starting torque for a variety of engine starting conditions.

The present description is related to starting an engine. The engine may be a type of engine described in FIG. 1 or a diesel engine. The engine may be part of a hybrid vehicle as is shown in FIG. 2. The torque for starting the engine may vary with engine temperature as shown in FIG. 3. The engine cranking speed may be selected according to the method described by the flowchart of FIG. 4. The engine may be selectively started as shown in FIG. 5 based on operating conditions. Engine cranking speed may be defined as a speed an engine is rotated before combustion commences within the engine and accelerates the engine.

Figure 1:
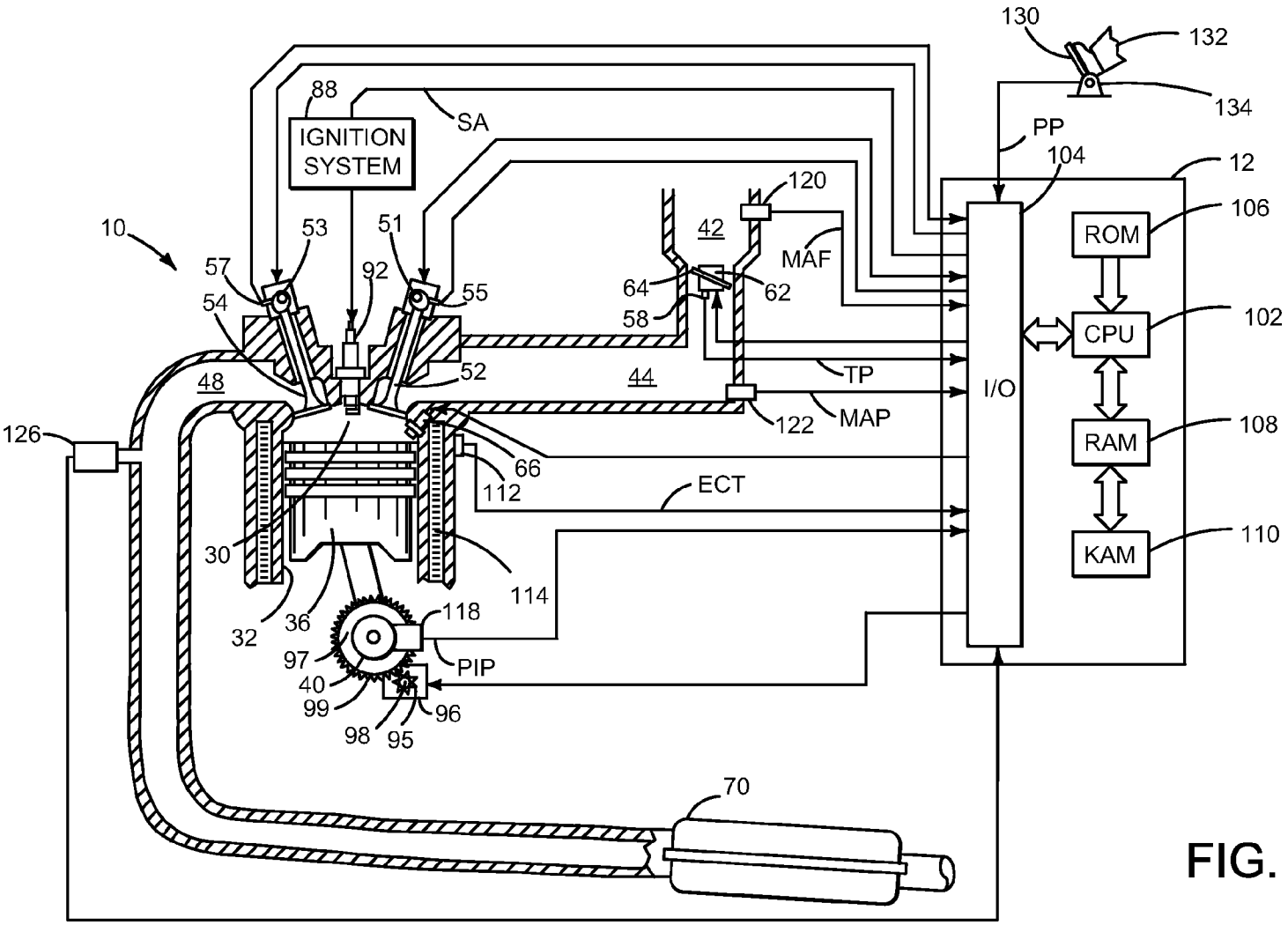
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Flywheel 97 and ring gear 99 are coupled to crankshaft 40. Starter 96 includes pinion shaft 98 and pinion gear 95. Pinion shaft 98 may selectively advance pinion gear 95 to engage ring gear 99. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. The position of intake cam 51 may be determined by intake cam sensor 55. The position of exhaust cam 53 may be determined by exhaust cam sensor 57. Intake cam 51 and exhaust cam 53 may be moved relative to crankshaft 40.

Fuel injector 66 is shown positioned to inject fuel directly into cylinder 30, which is known to those skilled in the art as direct injection. Alternatively, fuel may be injected to an intake port, which is known to those skilled in the art as port injection. Fuel injector 66 delivers liquid fuel in proportion to the pulse width of signal from controller 12. Fuel is delivered to fuel injector 66 by a fuel system (not shown) including a fuel tank, fuel pump, and fuel rail (not shown). In addition, intake manifold 44 is shown communicating with optional electronic throttle 62 which adjusts a position of throttle plate 64 to control air flow from air intake 42 to intake manifold 44. In one example, a high pressure, dual stage, fuel system may be used to generate higher fuel pressures. In some examples, throttle 62 and throttle plate 64 may be positioned between intake valve 52 and intake manifold 44 such that throttle 62 is a port throttle.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Alternatively, a two-state exhaust gas oxygen sensor may be substituted for UEGO sensor 126.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle as shown in FIG. 2. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

FIG. 2 is a block diagram of a vehicle driveline 200 and vehicle 290. Driveline 200 may be powered by engine 10. Engine 10 may be started with an engine starting system shown in FIG. 1 or via driveline integrated starter/generator (DISG) 240. Further, engine 10 may generate or adjust torque via torque actuator 204, such as a fuel injector, throttle, camshaft, valve lift, etc.

An engine output torque may be transmitted to an input side of dual mass flywheel 232. Engine speed as well as dual mass flywheel input side position and speed may be determined via engine position sensor 118. Dual mass flywheel 232 may include springs and separate masses (not shown) for dampening driveline torque disturbances. The output side of dual mass flywheel 232 is shown being mechanically coupled to the input side of disconnect clutch 236. Disconnect clutch 236 may be electrically or hydraulically actuated. A position sensor 234 may be positioned on the disconnect clutch side of dual mass flywheel 232 to sense the output position and speed of the dual mass flywheel 232. The downstream side of disconnect clutch 236 is shown mechanically coupled to DISG input shaft 237.

DISG 240 may be operated to provide torque to driveline 200 or to convert driveline torque into electrical energy to be stored in electric energy storage device 275. DISG 240 has a higher output torque capacity than starter 96 shown in FIG. 1. Further, DISG 240 directly drives driveline 200 or is directly driven by driveline 200. Electrical energy storage device 275 may be a battery, capacitor, or inductor. The downstream side of DISG 240 is mechanically coupled to the impeller 285 of torque converter 206 via shaft 241. The upstream side of the DISG 240 is mechanically coupled to the disconnect clutch 236. Torque converter 206 includes a turbine 286 to output torque to input shaft 270. Input shaft 270 mechanically couples torque converter 206 to automatic transmission 208. Torque converter 206 also includes a torque converter bypass lock-up clutch 212 (TCC). Torque is directly transferred from impeller 285 to turbine 286 when TCC is locked. TCC is hydraulically operated via controller 12 adjusting a position of a control valve. In one example, the torque converter may be referred to as a component of the transmission. Torque converter turbine speed and position may be determined via position sensor 239. In some examples, 238 and/or 239 may be torque sensors or may be combination position and torque sensors.

When torque converter lock-up clutch 212 is fully disengaged, torque converter 206 transmits engine torque to automatic transmission 208 via fluid transfer between the torque converter turbine 286 and torque converter impeller 285 (e.g., a hydraulic torque path), thereby enabling torque multiplication. In contrast, when torque converter lock-up clutch 212 is fully engaged, the engine output torque is directly transferred via the torque converter clutch to an input shaft (not shown) of transmission 208 (e.g., the friction torque path). Alternatively, the torque converter lock-up clutch 212 may be partially engaged, thereby enabling the amount of torque directly relayed to the transmission to be adjusted. The controller 12 may be configured to adjust the amount of torque transmitted by torque converter 212 by adjusting the torque converter lock-up clutch in response to various engine operating conditions, or based on a driver-based engine operation request.

Automatic transmission 208 includes gear clutches (e.g., gears 1-N where N is an integer number between 4-10) 211 and forward clutch 210. The gear clutches 211 and the forward clutch 210 may be selectively engaged to propel a vehicle. Torque output from the automatic transmission 208 may in turn be relayed to wheels 216 to propel the vehicle via output shaft 260. Specifically, automatic transmission 208 may transfer an input driving torque at the input shaft 270 responsive to a vehicle traveling condition before transmitting an output driving torque to the wheels 216.

Further, a frictional force may be applied to wheels 216 by engaging wheel brakes 218. In one example, wheel brakes 218 may be engaged in response to the driver pressing his foot on a brake pedal (not shown). In other examples, controller 12 or a controller linked to controller 12 may control the engagement of wheel brakes. In the same way, a frictional force may be reduced to wheels 216 by disengaging wheel brakes 218 in response to the driver releasing his foot from a brake pedal. Further, vehicle brakes may apply a frictional force to wheels 216 via controller 12 as part of an automated engine stopping procedure.

A mechanical pump 214 may supply pressurized transmission fluid to automatic transmission 208 providing hydraulic pressure to engage various clutches, such as forward clutch 210, gear clutches 211, engine disconnect clutch 236, and/or torque converter lock-up clutch 212. Mechanical pump 214 may be operated in accordance with torque converter 206, and may be driven by the rotation of the engine or DISG via input shaft 241, for example. Thus, the hydraulic pressure generated in mechanical pump 214 may increase as an engine speed and/or DISG speed increases, and may decrease as an engine speed and/or DISG speed decreases.

An electric pump 215 may also be provided to increase transmission line pressure when the DISG is spinning at speeds less than 300 RPM for example. Electric pump 215 may be selectively operated via controller 12 in response to DISG speed. Thus, mechanical pump 214 may supply transmission line pressure when the DISG speed is greater than a threshold speed while electrical pump 215 is not activated. However, when DISG speed is less than the threshold speed, electrical pump 215 may be activated to supply transmission line pressure.

Controller 12 may be configured to receive inputs from engine 10, as shown in more detail in FIG. 1, and accordingly control a torque output of the engine and/or operation of the torque converter, transmission, DISG, clutches, and/or brakes. As one example, an engine torque output may be controlled by adjusting a combination of spark timing, fuel pulse width, fuel pulse timing, and/or air charge, by controlling throttle opening and/or valve timing, valve lift and boost for turbo- or super-charged engines. In the case of a diesel engine, controller 12 may control the engine torque output by controlling a combination of fuel pulse width, fuel pulse timing, and air charge. In all cases, engine control may be performed on a cylinder-by-cylinder basis to control the engine torque output. Controller 12 may also control torque output and electrical energy production from DISG by adjusting current flowing to and from field and/or armature windings of DISG as is known in the art.

When engine stop conditions are satisfied, controller 12 may initiate engine shutdown by shutting off fuel and spark to the engine. However, the engine may continue to rotate in some examples. Further, to maintain an amount of torsion in the transmission, the controller 12 may ground rotating elements of transmission 208 to a case 259 of the transmission and thereby to the frame of the vehicle. In particular, the controller 12 may engage one or more transmission clutches, such as forward clutch 210, and lock the engaged transmission clutch(es) to the transmission case 259 and vehicle. A transmission clutch pressure may be varied (e.g., increased) to adjust the engagement state of a transmission clutch, and provide a desired amount of transmission torsion. When restart conditions are satisfied, and/or a vehicle operator wants to launch the vehicle, controller 12 may reactivate the engine by resuming cylinder combustion.

A wheel brake pressure may also be adjusted during the engine shutdown, based on the transmission clutch pressure, to assist in tying up the transmission while reducing a torque transferred through the wheels. Specifically, by applying the wheel brakes 218 while locking one or more engaged transmission clutches, opposing forces may be applied on transmission, and consequently on the driveline, thereby maintaining the transmission gears in active engagement, and torsional potential energy in the transmission gear-train, without moving the wheels. In one example, the wheel brake pressure may be adjusted to coordinate the application of the wheel brakes with the locking of the engaged transmission clutch during the engine shutdown. As such, by adjusting the wheel brake pressure and the clutch pressure, the amount of torsion retained in the transmission when the engine is shutdown may be adjusted.

Thus, the system of FIGS. 1 and 2 provides for a vehicle system, comprising: an electric machine; an engine in mechanical communication with the electric machine; and a controller including non-transitory instructions executable to crank the engine via the electric machine and adjust engine speed in response to battery pack and battery cell state of charge, battery pack and battery cell temperature, and a learned battery parameter map describing the parameters in a battery model used to project battery power capability, and a plurality of predetermined engine cranking speeds. The vehicle system includes where the plurality of predetermined engine cranking speeds include an engine idle speed, a cold start cranking speed, and a lower cranking speed. The vehicle system includes where the cold start cranking speed is less than the engine idle speed, and where the lower cranking speed is less than the cold start cranking speed.

In some examples, the vehicle system further comprises additional instructions for adjusting engine speed to the engine idle speed in response to battery power capability being greater than the power to crank the engine at the engine idle speed. The vehicle system further comprises additional instructions for adjusting engine speed to the engine a cold start cranking speed in response to battery power capability being less than the power to crank the engine at the engine idle speed. The vehicle system further comprises additional instructions to compare a result of multiplying a battery power capability by efficiency of the electric machine at a desired engine speed.

Referring now to FIG. 3, a prophetic plot of engine starting torque for various temperatures is shown. Plot 300 has an X axis that represents engine temperature in degrees Celsius and a Y axis that represents engine cranking torque in N-m. Engine starting torque curve 302 indicates engine cranking torque for rotating the engine at a constant RPM (e.g., 200 RPM) during engine cranking Curve 302 indicates that engine cranking torque is greatest at lower engine temperature. Higher engine cranking torque is indicative of higher engine friction and higher oil viscosity at lower engine temperatures. Additionally, it may be observed that engine cranking torque increases significantly between −5 and −20 degrees Celsius.

Figure 4:
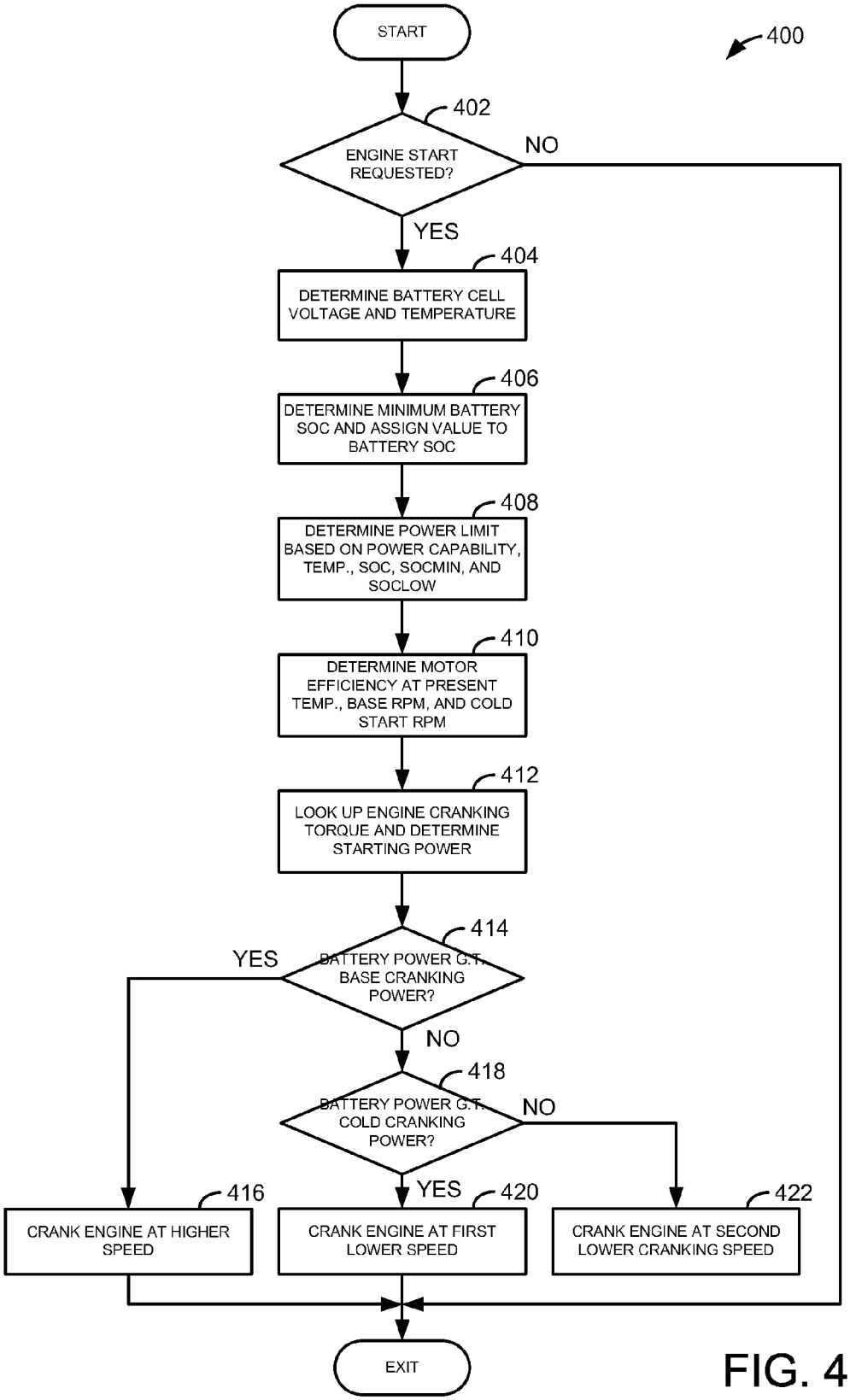
FIG. 4 shows a flowchart for a method for selective engine starting.
Figure 5:
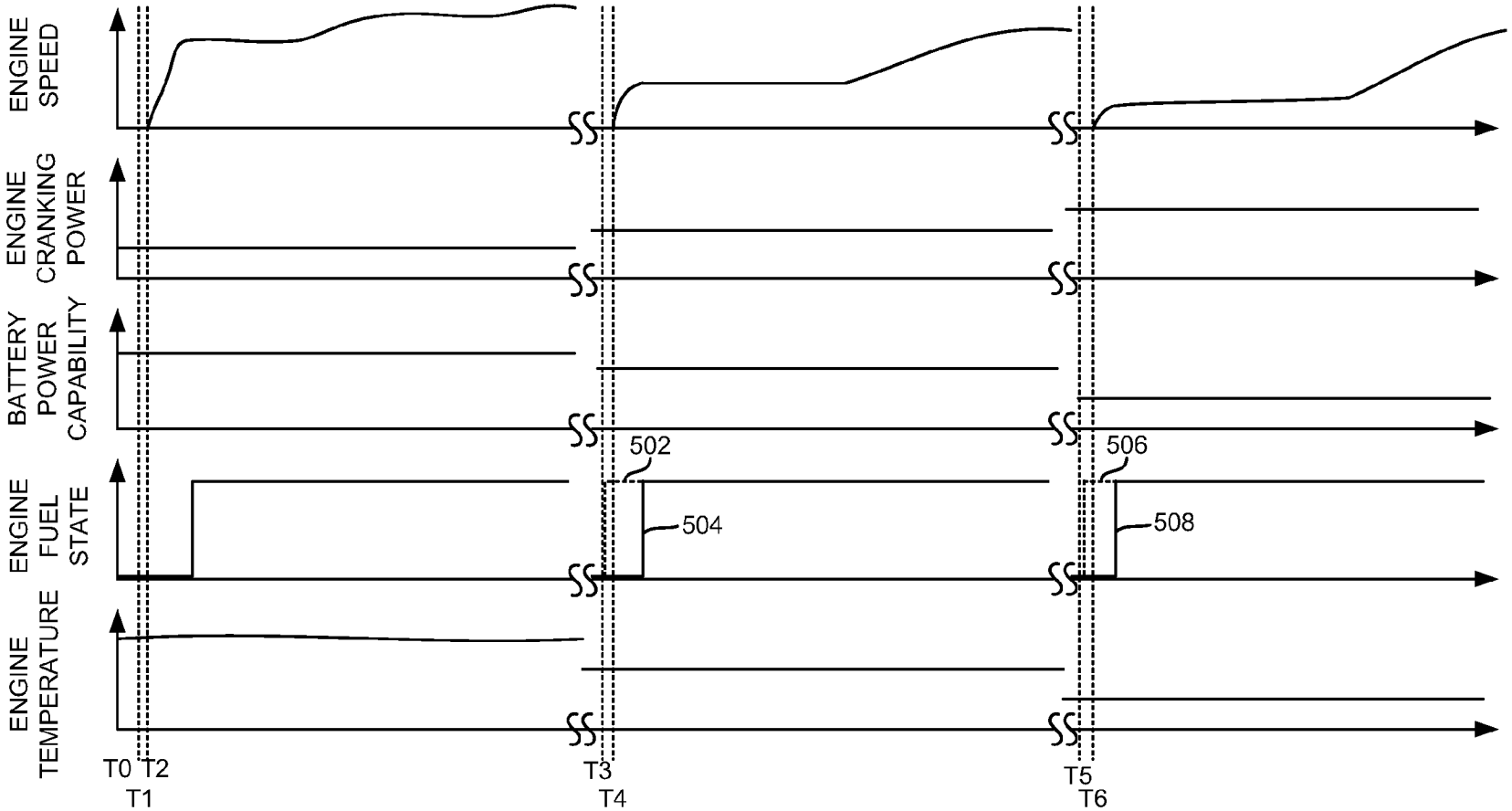
FIG. 5 shows example engine starting sequences according to the method of FIG. 4.

Referring now to FIG. 4, a flowchart of an example method for selectively starting an engine is shown. The method of FIG. 4 may be stored as executable instructions in non-transitory memory in the system shown in FIGS. 1 and 2. The method of FIG. 4 may provide the example engine starting sequences shown in FIG. 5.

At 402, method 400 judges whether or not an engine start request is present. An engine start request may be initiated via a driver or a controller that stops and starts the engine in response to vehicle operating conditions. If method 400 judges that a request to start the engine is present, the answer is yes and method 400 proceeds to 404. Otherwise, the answer is no and method 400 proceeds to exit.

At 404, method 400 determines battery cell temperature and voltage. Vehicle batteries may include a plurality of battery cells, and temperature and voltage of each battery cell may be determined. In one example, battery voltage may be determined via an analog to digital converter. Battery cell temperature may be determined via output of a thermistor or thermocouple. Method 400 proceeds to 406 after battery cell temperatures and voltages are determined.

At 406, method 400 determines a minimum battery cell state of charge (SOC). In one example, battery cell output voltage and battery cell temperature is used to index a function that outputs battery SOC based on battery cell voltage and temperature. SOC is determined for each battery cell and a corresponding open circuit voltage f(SOC) is determined as well. The function f increases monotonically and it is a 1 to 1 mapping between SOC and the open circuit voltage. The minimum value of $$\frac{f(SOC)}{r(\text{temperature}, SOC)}$$

for all battery cells may determine which battery cell has the lowest power capability. Method 400 proceeds to 408 after the battery SOC is determined.

At 408, method 400 determines the battery power limit based on SOC, SOC minimum, internal resistances, internal capacitance, and time since the battery last received charge or being discharged In one example, method 400 indexes tables and functions that hold empirically determined values of battery internal resistances, battery internal capacitance as function of battery cell temperature and SOCs. If the time since last charge or discharge has been sufficiently long, the battery cell power capability for engine cranking purposes may be described as:

$$P = V\min \cdot \frac{f(SOC) - V\min}{[r1 + r2(1 - e^{-t(r2 \cdot c)})} \quad \text{(equation 1)}$$

Where P is battery cell power capability, Vmin is battery cell lower voltage limit, SOC is battery cell's state of charge, r1 and r2 are internal resistances of the battery, c is internal capacitance of the battery, e is a constant approximated at 2.718, and t is time unit used to project battery power capability specifically for engine cranking purpose. For example, t may be 0.5 second in some applications. An engine cranking potential is defined as f(SOC)-Vmin.

The power capability for the battery is determined according to the equation of calculating cell power capability (Eqn. 1). In one example, if a battery is comprised of a number of battery cells connected as a string (series connection), battery pack power capability equals the total number of cells placed in series connection, times the minimum value of the cell power capabilities as determined by equation 1 (e.g., battery cell power capability). In yet another example, the power capability for the battery is based on SOC of the lowest output battery cell. In particular, the battery power capability for the battery cell having the lowest power capability is multiplied by the number of battery cells in the battery to provide the battery power capability. In yet another example, the power capability for the battery is based on lowest battery cell temperature. In yet another example, the power capability for the battery is based on the lowest ratio of battery cell cranking potential and highest battery cell resistance. In particular, the battery power capability for the battery cell having the lowest power capability is multiplied by the number of battery cells in the battery to provide the battery power capability. Method 400 proceeds to 410 after the battery power limit or capability is determined.

At 410, method 400 determines DISG or motor efficiency at the present ambient temperature. In one example, a function or table includes empirically determined values of DISG efficiency based on ambient temperature. Method 400 indexes the table or function using the present ambient temperature and the table or function outputs DISG efficiency. Method 400 proceeds to 412 after DISG efficiency is determined.

At 412, method 400 determines engine cranking torque to determine the power that will be consumed cranking the engine at different speeds. In particular, method 400 determines engine cranking torque from a function as is shown in FIG. 3. Further, in some examples, engine cranking torque for various cranking speeds may be adjusted as a function of engine cranking speed. For example, engine cranking torque at 1000 RPM may be adjusted to be greater value than engine cranking torque at 100 RPM for engines where engine friction increases with engine speed. Method 400 indexes the function via engine temperature and the function outputs an engine cranking torque estimate in units of N-m.

Method 400 also determines the power to crank the engine at base speed (e.g., an engine idle speed of 1000 RPM, cold start cranking speed (e.g., 300 RPM), and low cranking speed (e.g., 200 RPM). The power to crank the engine at each speed is determined by multiplying the respective engine cranking torque with the engine cranking speed that is based on engine temperature. Thus, method 400 determines power for cranking the engine at the present ambient temperature for base speed engine cranking, cold start engine cranking, and low cranking speed. Method 400 proceeds to 414 after power to crank the respective speeds is determined.

At 414, method 400 judges whether or not the power capability of the battery (e.g., as determined at 408) multiplied by the motor efficiency (e.g., as determined at 410) is greater than the amount of power to crank the engine at base speed (e.g., as determined at 412). If so, the answer is yes and method 400 proceeds to 416. Otherwise, the answer is no and method 400 proceeds to 418.

At 416, method 400 cranks the engine at base cranking speed. The DISG accelerates the engine to base cranking speed (e.g., 1000 RPM) before spark and fuel is supplied to the engine. Once the engine reaches the base cranking speed, spark and fuel are supplied to the engine. Engine emissions may be reduced by cranking the engine up to the base cranking speed before supplying spark and fuel to the engine since engine conditions are steady and engine speed is not changing during engine starting. Method 400 proceeds to exit after the engine is cranked and started at base engine cranking speed.

At 418, method 400 judges whether or not the power capability of the battery (e.g., as determined at 408) multiplied by the motor efficiency (e.g., as determined at 410) is greater than the amount of power to crank the engine at cold start cranking speed (e.g., as determined at 412). If so, the answer is yes and method 400 proceeds to 420. Otherwise, the answer is no and method 400 proceeds to 422.

At 420, method 400 cranks the engine at cold start cranking speed. The DISG accelerates the engine to cold start cranking speed (e.g., 300 RPM) before spark and fuel is supplied to the engine. Once the engine reaches the base cranking speed, spark and fuel are supplied to the engine. Alternatively, spark and fuel may be supplied to the engine before the DISG begins to rotate the engine. In other words, spark and fuel may be supplied to the engine when the engine is stopped and as the engine is accelerated to cold start cranking speed. Engine emissions may be increased somewhat when the engine is cranked at cold start cranking speed; however, the engine may be started using less electrical energy at cold start cranking speed, and therefore, there may be an even higher probability of starting the engine when less energy is available from the battery. Method 400 proceeds to exit after the engine is cranked and started at cold start cranking speed.

At 422, method 400 cranks the engine at low cranking speed. The DISG accelerates the engine to low cranking speed (e.g., 200 RPM) before spark and fuel is supplied to the engine. Once the engine reaches the low cranking speed, spark and fuel are supplied to the engine. Alternatively, spark and fuel may be supplied to the engine before the DISG begins to rotate the engine. In other words, spark and fuel may be supplied to the engine when the engine is stopped and as the engine is accelerated to low cranking speed. Engine emissions may be increased somewhat when the engine is cranked at low cranking speed; however, the engine may be started using less electrical energy at low cranking speed, and therefore, there may be an even higher probability of starting the engine when less energy is available from the battery. Method 400 proceeds to exit after the engine is cranked and started at low cranking speed.

Thus, the method of FIG. 4 provides for starting an engine, comprising: adjusting an engine cranking speed in response to battery power capability and an amount of power to crank an engine at a desired engine speed; and cranking the engine at the adjusted cranking speed. The method includes where engine cranking speed is an engine idle speed. The method includes where engine cranking speed is a cold start cranking speed. The method includes where engine cranking speed is lower than a cold start cranking speed.

In some examples, the method includes where the engine cranking speed is adjusted to an engine idle speed in response to battery power capability being greater than the power to crank the engine at the desired engine speed, and where the desired engine speed is the engine idle speed. The method includes where the engine cranking speed is adjusted to cold start cranking speed that is less than an engine idle speed in response to battery power capability being greater than the power to crank the engine at the cold start cranking speed and the battery power capability being less than the power to crank the engine at the engine idle speed. The method includes where the engine cranking speed is adjusted to a speed lower than cold start cranking speed in response to battery power capability being less than the power to crank the engine at the cold start cranking speed.

The method of FIG. 4 also provides for starting an engine, comprising: adjusting a battery power capability in response to output of a battery cell having a lowest ratio of crank potential and internal resistance among a plurality of battery cells in a battery; adjusting an engine cranking speed in response to the battery power capability and power to crank an engine at a desired engine speed; and cranking the engine at the adjusted cranking speed. Alternatively, battery power capability may be adjusted in response to output of a battery cell having a lowest temperature among a plurality of battery cells or in response to output power of a battery cell having a lowest state of charge among a plurality of battery cells in a battery. The method includes where the battery power capability is based on power capability of a plurality of battery cells in a battery. In some examples, the method further comprises comparing a result of multiplying the battery power capability by efficiency of a motor rotating the engine with the power to crank the engine at the desired engine speed. The method includes where power to crank the engine is estimated from engine temperature. The method further comprises adjusting the power to crank the engine based on the engine cranking speed. The method includes where the engine is cranked via a driveline integrated starter generator.

Referring now to FIG. 5, engine starting sequences according to the method of FIG. 4 are shown. The engine starting sequence of FIG. 5 may be performed via the system shown in FIGS. 1 and 2.

The first plot from the top of FIG. 5 is a plot of engine speed versus time. The X axis represents time and time increases from the left side of FIG. 5 to the right side of FIG. 5. The Y axis represents engine speed and engine speed increases in the direction of the Y axis arrow.

The second plot from the top of FIG. 5 is a plot of engine cranking power versus time. The X axis represents time and time increases from the left side of FIG. 5 to the right side of FIG. 5. The Y axis represents engine cranking power (e.g., the power used to crank the engine) and engine power torque increases in the direction of the Y axis arrow.

The third plot from the top of FIG. 5 is a plot of the vehicle's battery power capability (e.g., battery charge storage capacity multiplied by battery SOC) versus time. The X axis represents time and time increases from the left side of FIG. 5 to the right side of FIG. 5. The Y axis represents the vehicle battery power capability and the vehicle battery power capability increases in the direction of the Y axis arrow.

The fourth plot from the top of FIG. 5 is a plot of engine fuel delivery state versus time. The X axis represents time and time increases from the left side of FIG. 5 to the right side of FIG. 5. The Y axis represents engine fuel delivery state. Fuel is delivered to the engine when the engine fuel delivery state is at a higher level. Fuel is not delivered to the engine when the engine fuel delivery state is at a lower level. Thus, the engine is not combusting an air-fuel mixture when the engine fuel delivery state is low.

The fifth plot from the top of FIG. 5 is a plot of engine temperature versus time. The X axis represents time and time increases from the left side of FIG. 5 to the right side of FIG. 5. The Y axis represents engine temperature and engine temperature increases in the direction of the Y axis arrow. Brakes in time within the sequence is illustrated via SS markers.

At time T0, the engine is stopped rotating and the engine cranking power is at a lower level since the engine temperature is at a higher level. Engine friction may be reduced at higher temperatures and oil viscosity may decrease at higher engine temperatures. The battery power capability is at a higher level and fuel is not being delivered to the engine.

At time T1, a request to start the engine is made (not shown). The engine start request may be made by a driver or automatically via an engine controller. All other operating conditions remain the same as at time T0. The amount of power to crank the engine to each of a base speed, a cold start cranking speed, and a lower cranking speed is determined and compared to the battery power capability in response to the engine start request.

At time T2, engine speed begins to increase as the DISG or motor accelerates the engine to the base engine speed. The motor accelerates the engine to the base speed since the battery power capability is greater than the power to rotate the engine at the base speed. The base engine speed may be an engine idle speed (e.g., a speed between 800 and 1000 RPM). Fuel is not supplied to the engine until the engine reaches base speed as indicated by the engine fuel state.

In this way, when battery power capability is high and engine cranking power is low, the engine may be accelerated to a base speed for starting. Such conditions may be present after the engine has been operating and is stopped for a short period of time.

At time T3, a request to start the engine is made (not shown). The engine start request may be made by a driver or automatically via an engine controller. The operating conditions are different from the operating conditions at time T1. Specifically, engine temperature is lower and engine cranking power is increased. Further, battery power capability may be decreased. An amount of power to crank the engine to each of a base speed, a cold start cranking speed, and a lower cranking speed is determined and compared to the battery capability in response to the engine start request.

At time T4, engine speed begins to increase as the DISG or motor accelerates the engine to the cold start cranking speed (e.g., less than the base speed and greater than the low speed). The motor accelerates the engine to the cold start cranking speed since the battery power capability is less than the power to crank the engine at base speed and greater than the power to crank the engine at low speed. The cold start cranking speed may be a speed between 250 and 450 RPM. Fuel may be supplied to the engine before cranking as indicated by trace 502. Alternatively, fuel may not be supplied to the engine until the engine reaches base speed as indicated by the trace 504.

In this way, when battery power capability is at a middle level and engine cranking power is less than the battery power capability at cold start engine cranking speeds, the engine may be accelerated to the a cold start cranking speed for starting. Such conditions may be present after the engine has been stopped for a period of time.

At time T5, a request to start the engine is made (not shown). The engine start request may be made by a driver or automatically via an engine controller. The operating conditions are different from the operating conditions at times T1 and T3. Specifically, engine temperature is lower and engine cranking power is increased. Further, battery power capability is decreased. An amount of power to crank the engine to each of a base speed, a cold start cranking speed, and a lower cranking speed is determined and compared to the battery capability in response to the engine start request.

At time T6, engine speed begins to increase as the DISG or motor accelerates the engine to the lower cranking speed (e.g., below the cold start cranking speed). The motor accelerates the engine to the lower cranking speed since the battery power capability is less than the power to crank the engine at cold start cranking speed. The lower cranking speed may be a speed less than 250 RPM. Fuel may be supplied to the engine before cranking as indicated by trace 506. Alternatively, fuel may not be supplied to the engine until the engine reaches base speed as indicated by the trace 508.

In this way, when battery power capability is at a lower level and power to crank the engine is relatively high, the engine may be accelerated to the lower cranking speed for starting. Such conditions may be present after the engine has been stopped for a period of time in a cold environment.

As will be appreciated by one of ordinary skill in the art, method described in FIG. 4 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features, and advantages described herein, but is provided for ease of illustration and description. Although not explicitly illustrated, one of ordinary skill in the art will recognize that one or more of the illustrated steps or functions may be repeatedly performed depending on the particular strategy being used. Further, the described actions, operations, methods, and/or functions may graphically represent code to be programmed into non-transitory memory of the computer readable storage medium in the engine control system.

This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The invention claimed is:

1. A method for starting an engine, comprising:

determining a state of charge of a battery cell with a state of charge less than other battery cells in a battery;

determining a battery power capability based on the state of charge of the battery cell with the state of charge less than other battery cells in the battery, a battery cell lower voltage limit, two internal battery resistance values, and a constant e with an exponent, the exponent based on an internal capacitance of the battery cell;

determining an efficiency of a motor;

looking up an engine cranking torque via indexing a function via an engine temperature;

determining an engine cranking power via multiplying the engine cranking torque with engine cranking speed;

multiplying the battery power capability with the efficiency of the motor and comparing a result of the multiplication to a power to crank the engine at a desired engine speed;

adjusting the engine cranking speed in response to the comparison; and cranking the engine at the adjusted cranking speed.

2. The method of claim 1, further comprising adjusting timing of a first fuel injection for an engine start after an engine stop responsive to the battery power capability.

3. The method of claim 1, where the exponent of e also includes a ratio of cell crank potential and battery internal resistance.

4. The method of claim 1, where the power to crank the engine is estimated from engine temperature.

5. The method of claim 4, further comprising adjusting the power to crank the engine based on the engine cranking speed.

6. The method of claim 1, where the engine is cranked via a driveline integrated starter generator.

7. A vehicle system, comprising:

an electric machine;

an engine in mechanical communication with the electric machine; and a controller including non-transitory instructions executable by a processor to crank the engine via the electric machine and adjust engine speed in response to battery state of charge and a plurality of predetermined engine cranking speeds, additional controller instructions to select one of the plurality of predetermined engine cranking speeds based on multiplying a battery power capability with efficiency of a motor rotating the engine, and additional instructions for adjusting engine speed to an engine idle speed in response to battery power capability being greater than power to crank the engine at the engine idle speed, and where the efficiency of the motor is based on ambient temperature.

8. The vehicle system of claim 7, where the plurality of predetermined engine cranking speeds includes the engine idle speed, a cold start cranking speed, and a lower cranking speed, and further comprising:

comparing a result of multiplying the battery power capability with efficiency of the motor rotating the engine to a power to crank the engine at a desired engine speed as a basis for selecting one of the plurality of predetermined engine cranking speeds; and adjusting timing of a first fuel injection for an engine start after an engine stop responsive to the battery power capability.

9. The vehicle system of claim 8, where the cold start cranking speed is less than the engine idle speed, where the lower cranking speed is less than the cold start cranking speed, where timing of the first fuel injection for the engine start after the engine stop is after engine speed achieves engine idle speed based on battery power capability multiplied with motor efficiency being greater than power to crank the engine at idle speed, and where timing of the first fuel injection for the engine start after the engine stop is before engine rotation based on battery power capability multiplied with motor efficiency being less than power to crank the engine at idle speed.

10. A vehicle system, comprising:

an electric machine;

an engine in mechanical communication with the electric machine; and a controller including non-transitory instructions executable by a processor to crank the engine via the electric machine and adjust engine speed in response to battery state of charge and a plurality of predetermined engine cranking speeds, additional controller instructions to select one of the plurality of predetermined engine cranking speeds based on multiplying a battery power capability with efficiency of a motor rotating the engine, and additional instructions for adjusting engine speed to a cold start cranking speed in response to battery power capability being less than power to crank the engine at engine idle speed, and where the power to crank the engine is based on multiplying an engine cranking torque with an engine cranking speed that is based on engine temperature.

* * * * *